US006864760B1

(12) United States Patent
Tsuru et al.

(10) Patent No.: US 6,864,760 B1
(45) Date of Patent: Mar. 8, 2005

(54) DELAY LINE WITH A PARALLEL CAPACITANCE FOR ADJUSTING THE DELAY TIME

(75) Inventors: Teruhisa Tsuru, Kameoka (JP); Mitsuhiro Matsumoto, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 442 days.

(21) Appl. No.: 09/583,171

(22) Filed: May 30, 2000

(30) Foreign Application Priority Data

Jun. 1, 1999 (JP) ..... 11-154044

(51) Int. Cl.[7] ..... H01P 1/18
(52) U.S. Cl. ..... 333/161; 333/156; 333/139
(58) Field of Search ..... 333/161, 156, 333/138, 139

(56) References Cited

U.S. PATENT DOCUMENTS 4,701,714 A 10/1987 Agoston
5,187,455 A 2/1993 Mandai et al.
5,208,213 A * 5/1993 Ruby ..... 505/1
5,436,601 A * 7/1995 Mandai et al. ..... 333/138
5,760,661 A * 6/1998 Cohn ..... 333/161
5,929,722 A * 7/1999 Kono ..... 333/177
6,201,457 B1 * 3/2001 Hickernell ..... 333/193
6,633,748 B1 * 10/2003 Watanabe et al. ..... 455/78

FOREIGN PATENT DOCUMENTS

| | | |
|---|---|---|
| GB | 1239596 | 7/1971 |
| JP | 62097416 | 5/1987 |
| JP | 62-109418 | 5/1987 |

OTHER PUBLICATIONS

European Search Report dated Jan. 24, 2002.

* cited by examiner

*Primary Examiner*—Benny Lee
*Assistant Examiner*—Kimberly E Glenn
(74) *Attorney, Agent, or Firm*—Keating & Bennett, LLP

(57) ABSTRACT

A delay line comprising a dielectric substrate including a pair of main surfaces; a transmission line disposed on one of the main surfaces of the dielectric substrate; a ground conductor disposed on the other of the main surfaces of the dielectric substrate; and at least one of a variable capacitor and a diode being disposed on the dielectric substrate and connected in parallel to the transmission line for setting a desired delay time of the delay line. In the above delay line, the delay time can be adjusted even after the delay line is mounted on a printed circuit board, and further, the delay time can be continuously adjusted. The delay line can also be formed in a multilayer structure rather than on the above dielectric substrate.

6 Claims, 7 Drawing Sheets

DELAY LINE WITH A PARALLEL CAPACITANCE FOR ADJUSTING THE DELAY TIME

BACKGROUND OF THE INVENTION

1. Field of the Invention

The present invention relates to delay lines used for delaying signal transmission in computers, measurement apparatuses, and the like. More specifically, the invention relates to delay lines in which delay time can be adjusted.

2. Description of the Related Art

FIG. 9 is a top view of a prior art example of a delay line. A delay line 80 has a structure in which a transmission line 82 used for a signal line is folded in a meandering manner and disposed on one of the main surfaces of a dielectric substrate 81, and a ground conductor (not shown) is disposed on substantially all of the other main surface of the dielectric substrate 81. The ends of the transmission line 82 are connected to an input terminal 83, and an output terminal 84, respectively. The entire length of the transmission line 82 determines the delay time between the input terminal 83 and the output terminal 84. In order to change the delay time, as shown in FIG. 9, an intermediate tap terminal 85 is disposed at a certain point on the meandering transmission line 82 and used, for example, as an output terminal, thereby providing a different delay time. The intermediate tap terminal 85 is adapted to be connected to the transmission line 82 at different positions, whereby the delay time can be changed by changing the position.

However, in the case of the above delay line, when the position of an output terminal has been set according to a desired delay time, it is impossible to adjust the delay time again, after the delay line has been mounted in a printed circuit board or the like.

In addition, since one of the three terminals is not used, the unused terminal generates a capacitance or works as a stub, which leads to a problem of causing the reflection of a signal.

In addition, as shown in FIG. 9, when a transmission line to be used has a meandering configuration, an intermediate tap terminal can be connected only to the lower-side curved part of the meandering transmission line. As a result, it is impossible to adjust delay time continuously.

SUMMARY OF THE INVENTION

To overcome the above described problems, embodiments of the present invention provide a delay line in which delay time can be adjusted even after being mounted on a printed circuit board, and in which the delay time can continuously be adjusted.

One preferred embodiment of the present invention provides a delay line comprising: a dielectric substrate including a pair of main surfaces; a transmission line disposed on one of the main surfaces of the dielectric substrate; a ground conductor disposed on the other of the main surfaces of the dielectric substrate; and a capacitance, provided by at least one of a variable capacitor and a diode, for example, being disposed on the dielectric substrate and connected to the transmission line, advantageously in parallel with the transmission.

According to the above described structure and arrangement, by changing the capacitance of the variable capacitor or the diode, a frequency of an attenuation pole in the pass characteristic of the delay line can be continuously changed even after the delay line is mounted on a printed circuit board. As a result, the delay time of the delay line can be continuously changed so as to obtain a desired delay time.

Another embodiment of the present invention provides a delay line comprising: a multilayer structure formed by laminating a plurality of dielectric layers; a transmission line embedded in the multilayer structure; a plurality of ground conductors disposed on the dielectric layers and being separated from each other by the transmission line and the dielectric layer; and at least one of a variable capacitor and a diode being disposed on the multilayer structure and connected in parallel to the transmission line.

According to the above described structure and arrangement, in addition to the advantages of the first embodiment, the transmission line is formed inside the multilayer structure in which the plurality of the dielectric layers are laminated.

Therefore, the wiring between the transmission line and the variable capacitor can also be formed inside the multilayer structure. Therefore, losses caused by the wiring can be suppressed, and it is possible to obtain a delay line having more satisfactory characteristics.

Other features and advantages of the present invention will become apparent from the following description of embodiments of the invention which refers to the accompanying drawings.

DETAILED DESCRIPTION OF EMBODIMENTS OF THE INVENTION

Figure 1A:
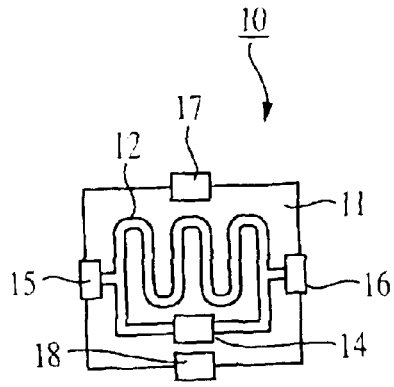
FIG. 1A shows a top view of a delay line according to a first embodiment of the present invention.
Figure 1B:
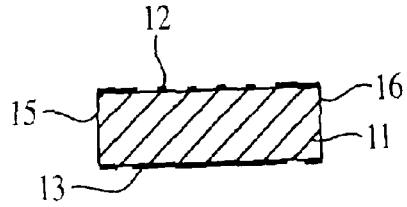
FIG. 1B shows a sectional view thereof.

FIG. 1A shows a top view of a delay line according to a first embodiment of the present invention, and FIG. 1B shows a sectional view thereof. A delay line 10 has a dielectric substrate 11. A transmission line 12 used for a signal line is disposed on one of the main surfaces of the dielectric substrate 11. The transmission line 12 is folded in a meandering manner. On substantially the entire back surface of the dielectric substrate 1, a ground conductor 13 is formed.

A variable capacitance trimmer capacitor 14 is connected in parallel to the transmission line 12. In addition, the ends of the transmission line 12 are connected to an input terminal 15 and an output terminal 16, respectively. The ground conductor 13 is connected to ground terminals 17 and 18, respectively.

Figure 2:
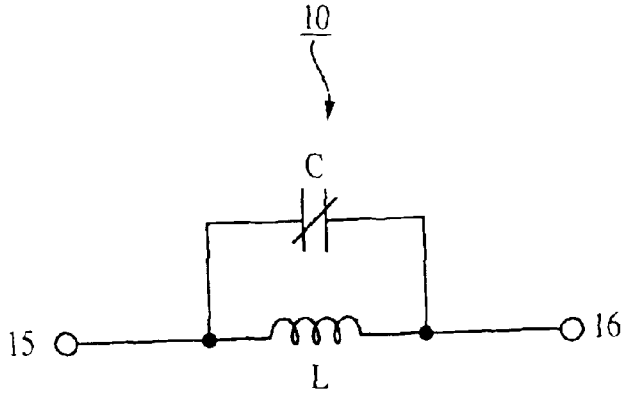
FIG. 2 shows an equivalent circuit diagram of the delay line shown in FIGS. 1A and 1B.

FIG. 2 is an equivalent circuit diagram of the delay line shown in FIG. 1. The delay line 10 has a structure in which an inductance component L of a micro strip line formed by the transmission line 12 and the ground conductor 13 are connected in parallel to a capacitance C of the trimmer capacitor 14 between the input terminal 15 and the output terminal 16.

In addition, in the pass characteristics, an attenuation pole is generated at a frequency obtained by an expression $1/(2\pi(L\cdot C)^{1/2})$. With the attenuation pole, phase changes occur in high frequency signals passing through the transmission line 12. As a result, the delay time of the delay line 10 changes according to frequency.

Figure 3:
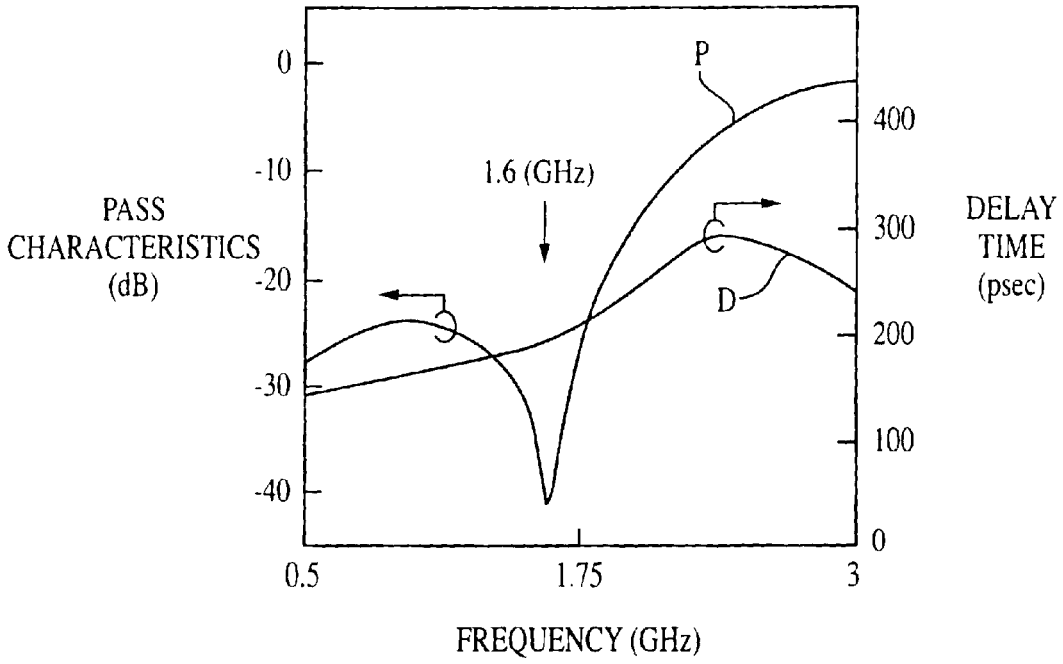
FIG. 3 shows a graph illustrating the pass characteristics of the delay line shown in FIGS. 1A and 1B, and the frequency dependence of the delay time of the delay line.

FIG. 3 shows a graph illustrating the pass characteristic of the delay line 10 shown in FIG. 1, and the frequency dependence of delay time thereof. In this figure, a solid line indicates the pass characteristic, and a broken line D indicates the delay time. The inductance component L of the transmission line 12 is 20 (nH), and the capacitance C of the trimmer capacitor 14 is 0.5 (pF).

This figure shows that, in the pass characteristics, an attenuation pole occurs near a frequency of 1.6 (GHz) obtained by the expression $1/(2\pi(L\cdot C)^{1/2})$, and due to the influence of the attenuation pole, the delay time greatly changes.

Figure 4:
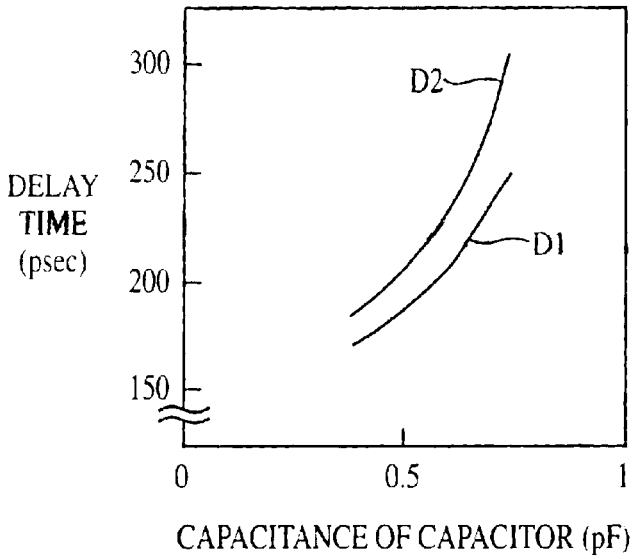
FIG. 4 shows a graph illustrating the capacitance dependence of the delay time of the delay line shown in, FIGS. 1A and 1B.

FIG. 4 is a graph illustrating the capacitance dependence of the delay time of the delay line 10 shown in FIG. 1. In FIG. 4, the horizontal axis of the graph indicates the capacitance of the trimmer capacitor 14, and the vertical axis thereof indicates the delay time of the delay line 10. In addition, a solid line D1 shows changes of the delay time at a frequency of 1.5 GHz, and a broken line D2 shows changes of the delay time at a frequency of 1.7 GHz.

This figure shows that adjustment of the capacitance of the trimmer capacitor 14 permits the delay time of the delay line 10 to be adjusted. The reason for this is that when the capacitance of the trimmer capacitor 14 is changed, the frequency of the attenuation pole, which is obtained by the expression $1/(2\pi(L\cdot C)^{1/2})$., also changes.

In the delay line of the first embodiment described above, since the variable trimmer capacitor is connected in parallel to the transmission line, continuously changing the capacitance of the trimmer capacitor also continuously changes the frequency at which the attenuation pole occurs in the pass characteristic. As a result, it is possible to continuously change the delay time of the delay line so as to obtain a desired delay time.

Figure 5:
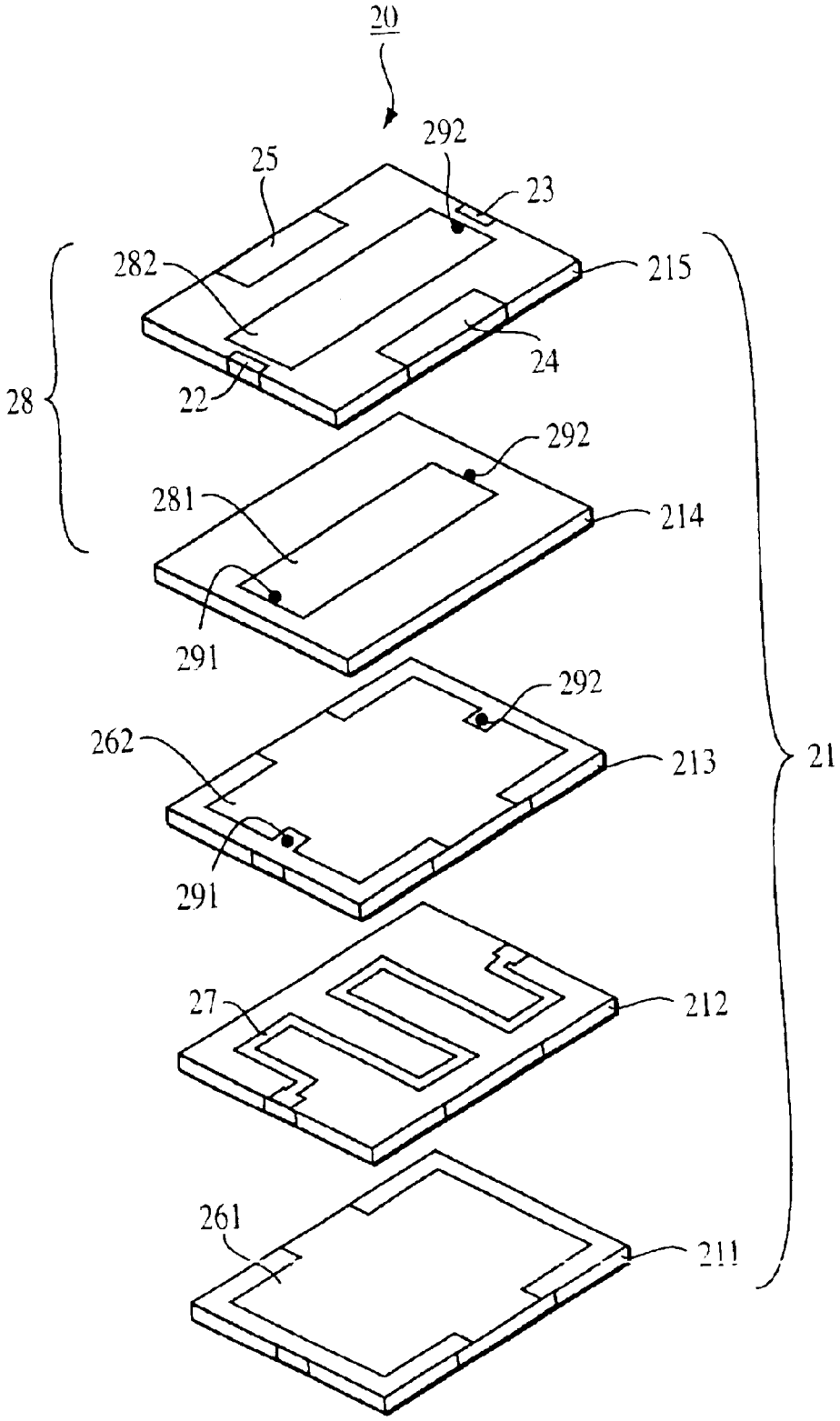
FIG. 5 is an exploded perspective view of a delay line according to a second embodiment of the present invention.

FIG. 5 is an exploded perspective view of a delay line according to a second embodiment of the present invention. A delay line 20 has a rectangular-parallelepiped multilayer structure 21 obtained by sequentially laminating rectangular dielectric layers 211 to 215 formed of dielectric ceramic materials (relative permittivity $\epsilon r$: approximately 6.0), whose main components comprise barium oxide, aluminum oxide, and silica, bonding by pressurizing and then integrally firing at temperatures of 800 to 1000° C. On the side surfaces and upper and lower surfaces of the multilayer structure 21, an input terminal 22, an output terminal 23, and two ground terminals 24 and 25 are formed.

Substantially rectangular ground conductors 261 and 262 are formed on the upper surfaces of the dielectric layers 211 and 213, respectively. In addition, a transmission line 27 is disposed on the upper surface of the dielectric layer 212 in a substantially meandering form. Furthermore, substantially rectangular capacitor electrodes 281 and 282 are formed on the upper surfaces of the dielectric layers 214 and 215, respectively.

In this case, both ends of the transmission line 27 formed on the upper surface of the dielectric layer 212, and parts of the ground conductors 261 and 262 formed on the upper surfaces of the dielectric layers 211 and 213 are extended onto the side surfaces of the multilayer structure 21 be connected to the input terminal 22, the output terminal 23, and the ground terminals 24 and 25, respectively.

In addition, an end of the transmission line 27 on the upper surface of the dielectric layer 212 is connected to the capacitor electrode 281 on the upper surface of the dielectric layer 214 by a via-hole conductor 291 disposed in such a manner that the via-hole conductor 291 passes through the dielectric layers 213 and 214.

Furthermore, the other end of the transmission line 27 on the upper surface of the dielectric layer 212 is connected to the capacitor electrode 282 on the upper surface of the dielectric layer 215 by a via-hole conductor 292 disposed in such a manner that the via-hole conductor 291 passes through the dielectric layers 213 to 215.

With such a structure, in the delay line 20, between the input terminal 22 and the output terminal 23, the inductance component L of the strip line formed by the transmission line 27 and the ground conductors 261 and 262 is connected in parallel to the capacitance component C of the variable capacitor 28 formed by the capacitor electrodes 281 and 282.

In this case, the equivalent circuit of the delay line 20 is the same as the equivalent circuit of the delay line 10 shown in FIG. 2.

The input terminal 22, the output terminal 23, and the ground terminals 24 and 25 are formed by firing printed conductive paste simultaneously with the multilayer structure 21, or by baking the printed conductive paste after the multilayer structure 21 has been fired.

After this, the capacitor electrode 282 formed on the upper surface of the multilayer structure 21 is trimmed by a laser or the like, by which the capacitance of the variable capacitor 28 can be continuously changed to set the delay time of the delay line 20, as in the delay line 10 (FIG. 1) of the first embodiment.

Figure 6:
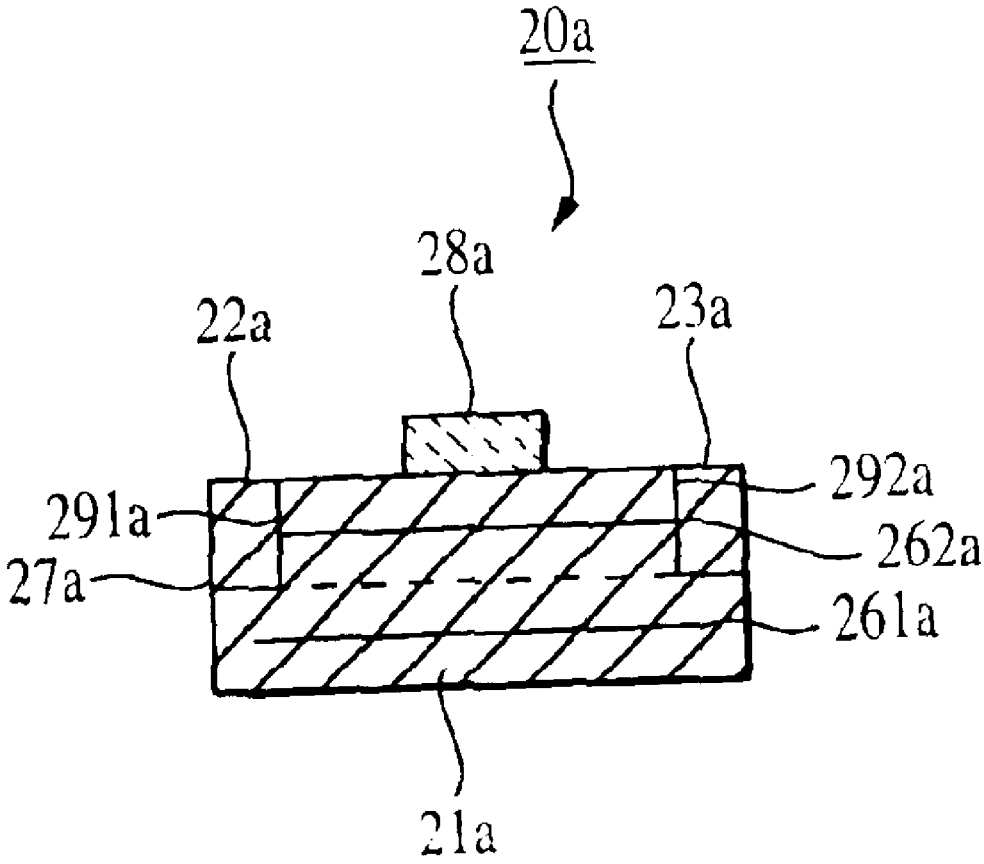
FIG. 6 is a sectional view of a modified example of the delay line shown in FIG. 5.

FIG. 6 is a sectional view of a modified example of the delay line shown in FIG. 5. When compared with the delay line 20 shown in FIG. 5, the structure of the delay line 20*a* is different in that it includes a trimmer capacitor 28*a*, as an alternative to the variable capacitor 28 (FIG. 5) formed by the capacitor electrodes 281 and 282, on the upper surface of the multilayer structure 21*a* having ground conductors 261*a* and 262*a*, and a transmission line 27*a* formed therein.

In this case, the transmission line 27*a* is connected to the trimmer capacitor 28*a* by via-hole conductors 291*a* and 292*a* disposed inside the multilayer structure 21*a*.

In the delay line of the second embodiment described above, since the capacitance of the trimmer capacitor can be continuously changed, even after being mounted on a printed circuit board, a frequency at which an attenuation pole occurs in the pass characteristics can also be continuously changed. As a result, the delay time of the delay line can be continuously changed so as to obtain a desired delay time.

In addition, since the transmission line is formed inside the multilayer structure in which the plurality of the dielectric layers are laminated, the wiring between the transmission line and the variable capacitor can be formed inside the multilayer structure. As a result, losses caused by the wiring can be suppressed, and a delay line having more satisfactory characteristics can thereby be obtained.

Figure 7:
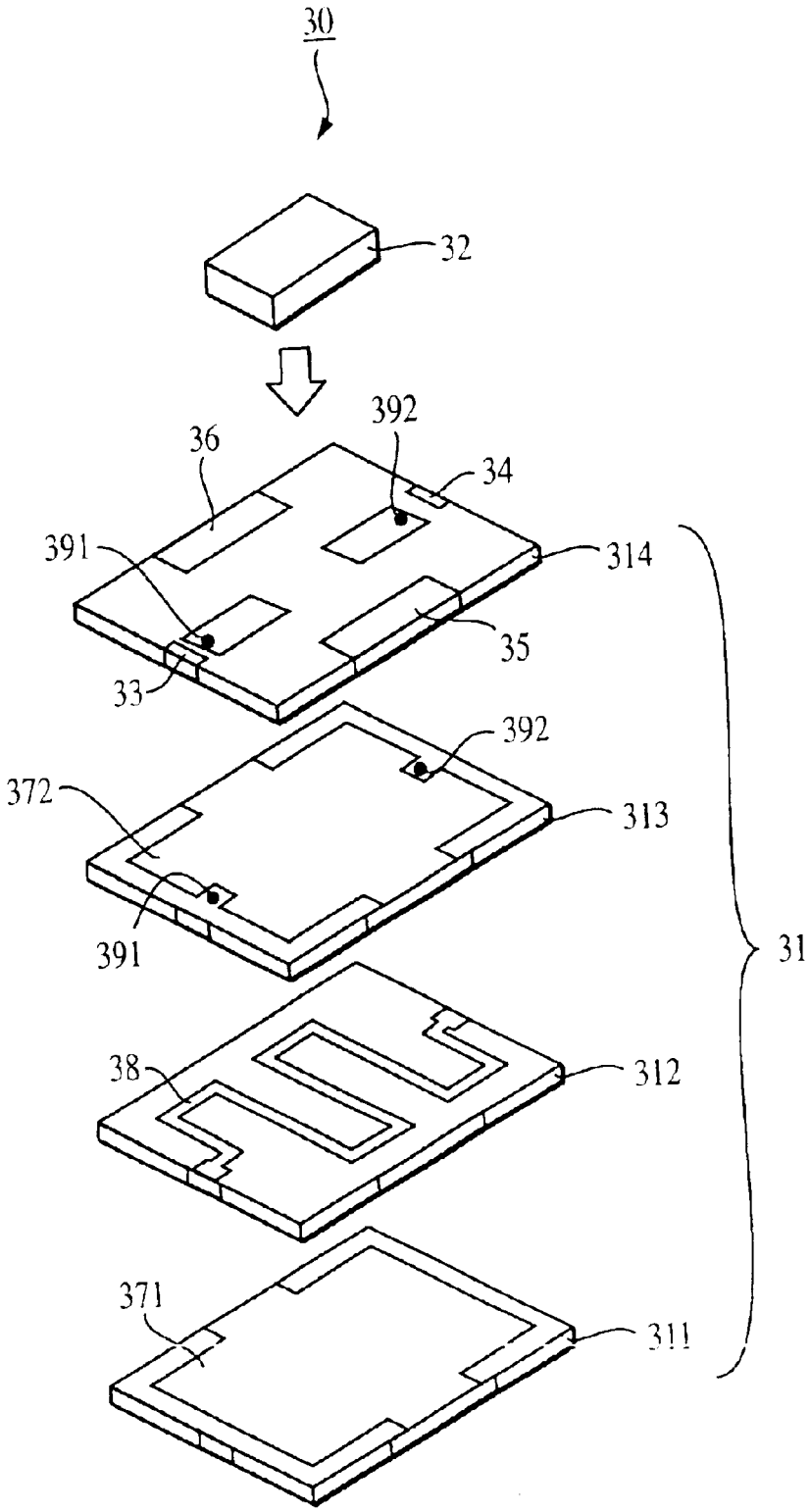
FIG. 7 is an exploded perspective view of a delay line according to a third embodiment of the present invention.

FIG. 7 is an exploded perspective view of a delay line according to a third embodiment of the present invention. A delay line 30 has a rectangular-parallelepiped multilayer structure 31 obtained by sequentially laminating rectangular dielectric layers 311 to 314 formed of dielectric ceramic materials (relative permittivity $\epsilon r$:approximately 6.0), whose main components comprise barium oxide, aluminum oxide, and silica, bonding by pressurizing, and then integrally firing at temperatures of 800 to 1000° C.

A varicap diode 32 is mounted on the upper surface of the multilayer structure 31. An input terminal 33, an output terminal 34, and two ground terminals 35 and 36 are formed on the side surfaces of the multilayer structure 31, and the upper and lower surfaces thereof.

Substantially rectangular ground conductors 371 and 372 are formed on the upper surfaces of the dielectric layers 311 and 313. In addition, a transmission line 38 having a substantially meandering configuration is formed on the upper surface of the dielectric layer 312.

In this case, both ends of the transmission line 38 formed on the dielectric layer 312, and parts of the ground conductors 371 and 372 formed on the upper surfaces of the dielectric layers 311 and 313 are extended onto the side surfaces of the multilayer structure 31 to be connected to the input terminal 33, the output terminal 34, and the ground terminals 35 and 36, respectively.

In addition, an end of the transmission line 38 on the upper surface of the dielectric layer 312 is connected to an end of the varicap diode 32 mounted on the multilayer structure 31 by a via-hole conductor 391 disposed in such a manner that the via-hole conductor 391 passes through the dielectric layers 313 and 314.

Furthermore, the other end of the transmission line 38 on the upper surface of the dielectric layer 312 is connected to the other end of the varicap diode 32 mounted on the multilayer structure 31 by a via-hole conductor 392 disposed in such a manner that the via-hole conductor 392 passes through the dielectric layers 313 and 314.

With such an arrangement, in the delay line 30, between the input terminal 33 and the output terminal 34, the inductance component L of the strip line formed by the transmission line 38 and the ground conductors 371 and 372 are connected in parallel to the capacitance component C of the varicap diode 32.

In this case, the equivalent circuit of the delay line 30 is the same as the equivalent circuit of the delay line 10 shown in FIG. 2.

As in the case of the delay line 20 of the second embodiment, the input terminal 33, the output terminal 34, and the ground terminals 35 and 36 are formed either by firing printed conductive paste simultaneously with the multilayer structure 31, or by baking the printed conductive paste after the multilayer structure 31 is fired.

With this structure by changing the voltage applied to the varicap diode 32 mounted on the upper surface of the multilayer structure 31, the capacitance component of the varicap diode 32 can also be changed continuously. As a result, the delay time of the delay line 30 can be continuously changed, as in the cases of the delay lines 10 (FIG. 1) and 20 (FIG. 5) of the first and second embodiments.

Figure 8:
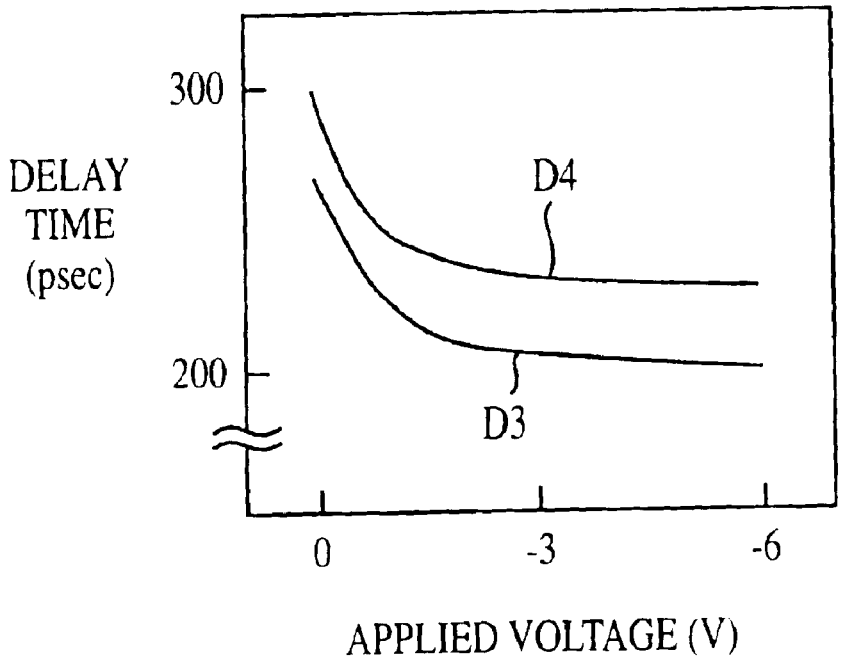
FIG. 8 is a graph illustrating an applied voltage dependence of the delay time of the delay line shown in FIG. 7.
Figure 9:
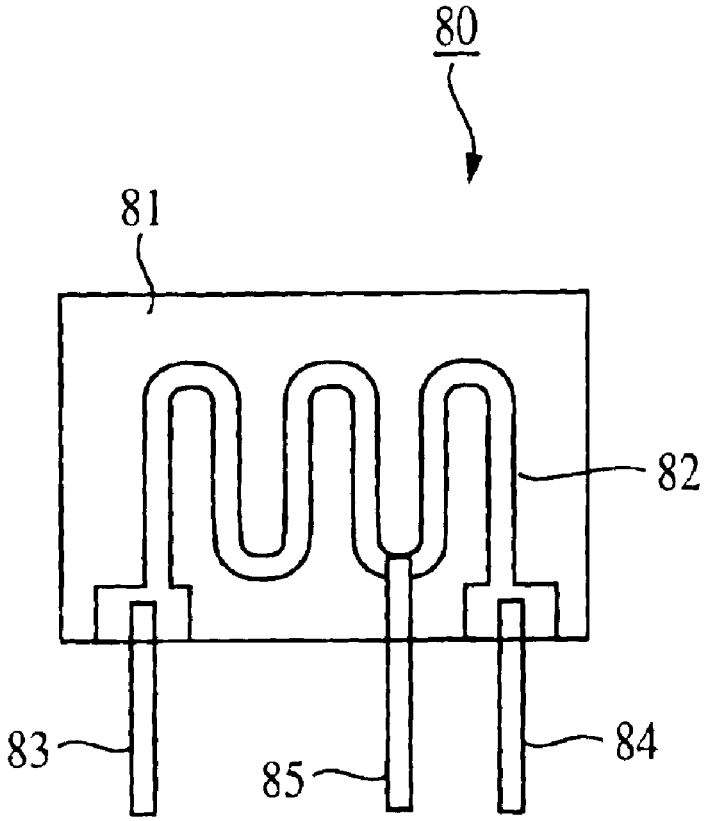
FIG. 9 PRIOR ART
FIG. 9 is a top view illustrating a prior art delay line.

FIG. 8 is a graph showing changes of the delay time of the delay line shown in FIG. 7. In FIG. 8, the horizontal axis of the graph indicates a voltage applied to the diode 32, and the vertical axis thereof indicates the delay time of the delay line. A solid line D3 shows changes of the delay time at a frequency of 1.5 GHz, and a broken line D4 shows changes of the delay time at a frequency of 1.7 GHz.

This graph shows that, when the voltage applied to the varicap diode 32 is changed, the delay time of the transmission line 38 can be changed. The reason for this is that changing the voltage applied to the varicap diode 32 changes the capacitance component of the varicap diode 32, by which a frequency at which the attenuation pole occurs in the pass characteristics is also changed, since the varicap diode is connected in parallel to the transmission line.

In the first to third embodiments, the dielectric layers have been formed of ceramic materials whose main components comprise barium oxide, aluminum oxide, and silica. However, any material can be used as long as the value of the relative permittivity ($\epsilon r$) is 1 or greater. For example, a ceramic material whose components comprise magnesium oxide and silica or a material of fluoropolymers can be used to obtain the same advantages.

In addition, a description has been given of cases in which either a variable capacitor or a diode is connected to the transmission line. Alternatively, both a variable capacitor and a diode may be connected to the transmission line, advantageously is parallel thereto.

Although the first embodiment has described the use of a variable capacitor connected in parallel to the transmission line, the same advantages can also be obtained by using a diode on the dielectric substrate.

In the second and third embodiments, the ground conductors are disposed inside the multilayer structure. However, any way of arranging the ground conductors can be applied as long as the dielectric layer is disposed between the transmission line and the ground conductors. Alternatively, the ground conductors may be disposed on outer surfaces of the multilayer structure.

In addition, in the above description, via-hole conductors are used for connecting the transmission line to the variable-capacity capacitor and the diode, respectively. Alternatively, the same advantages can also be obtained by using through-hole conductors.

Further, although all of the disclosed embodiments have the equivalent circuit shown in FIG. 3, other circuit arrangements may be used as long as a variable capacitance is connected to a transmission line so as to be able to continuously adjust a desired delay time of the delay line.

While the invention has been particularly shown and described with reference to preferred embodiments thereof, it will be understood by those skilled in the art that the foregoing and other changes in form and details may be made therein without departing from the spirit of the invention.

What is claimed is:

1. A delay line comprising:

a multilayer structure formed by laminating a plurality of dielectric layers;

a transmission line formed on a dielectric layer embedded in the multilayer structure;

a plurality of ground conductors disposed on the dielectric layers and a pair of said ground conductors being disposed on opposite sides of the transmission line; and a capacitance disposed on the multilayer structure and connected in parallel to the transmission line for setting a desired delay time of the delay line, wherein said capacitance is adjustable.

2. A delay line according to claim 1, wherein said capacitance is provided by electrodes formed on respective ones of said dielectric layers.

3. A delay line according to claim 1, wherein said capacitance is provided by a variable capacitor.

4. A delay line according to claim 1, wherein said capacitance is provided by a varicap diode.

5. A delay line comprising:

a multilayer structure formed by laminating a plurality of dielectric layers;

a transmission line formed on a dielectric layer embedded in the multilayer structure;

a plurality of ground conductors disposed on the dielectric layers and a pair of said ground conductors being disposed on opposite sides of the transmission line; and a capacitance disposed on the multilayer structure and connected in parallel to the transmission line for setting a desired delay time of the delay line, wherein said capacitance is provided by a diode.

6. A delay line according to claim 5, wherein said diode is a varicap diode.

* * * * *